United States Patent [19]

Diaz

[11] Patent Number: 4,583,275

[45] Date of Patent: Apr. 22, 1986

[54] TRANSMISSION DIRECT CLUTCH DRUM REMOVING AND INSTALLING TOOL

[76] Inventor: Eusebio M. Diaz, 6450 Balboa Blvd., Van Nuys, Calif. 91406

[21] Appl. No.: 770,972

[22] Filed: Aug. 30, 1985

[51] Int. Cl.[4] ..... B25B 27/14

[52] U.S. Cl. ..... 29/278; 294/95

[58] Field of Search ..... 294/95, 94, 115, 100, 294/50.5; 269/48.1; 29/234, 278–280, 261

[56] References Cited

U.S. PATENT DOCUMENTS

| | | | |
|---|---|---|---|
| 868,690 | 10/1907 | O'Kane | 294/115 |
| 2,336,527 | 12/1943 | Bullington | 294/115 |
| 2,951,725 | 9/1960 | St. Jean | 294/115 |

FOREIGN PATENT DOCUMENTS

| | | | |
|---|---|---|---|
| 204161 | 9/1923 | United Kingdom | 294/115 |

*Primary Examiner*—Robert C. Watson

*Attorney, Agent, or Firm*—Albert O. Cota

[57] ABSTRACT

A transmission direct clutch drum removing and installing tool for use on a General Motors Corporation Turbo-Hydromatic 400 automatic transmission. The tool comprises a round plate platform base (20) and a spacer channel (26) attached to its periphery, each having an opening in the center. A plurality of legs (30), each having a retainer (34) on its lower end, are pivotally connected to the bottom of the base (20). A T-shaped operating handle slideably penetrates the opening in the base (20) and channel (26), and contains a leg directing expansion guide disc (40) on the end opposite the handle grip. Between the base (20) and disc (40) is a free floating locking disc (46) that assures the alignment of the legs (30) without binding or internal bowing. To operate the tool, the handle extended allowing the legs (30) to be grouped together and placed within the sides of the clutch drum. When the handle section (36) is pushed downwardly, the legs (30) are forced outwardly grabbing the sides of the clutch drum. Thus, allowing the operator to remove or install the clutch drum.

4 Claims, 7 Drawing Figures

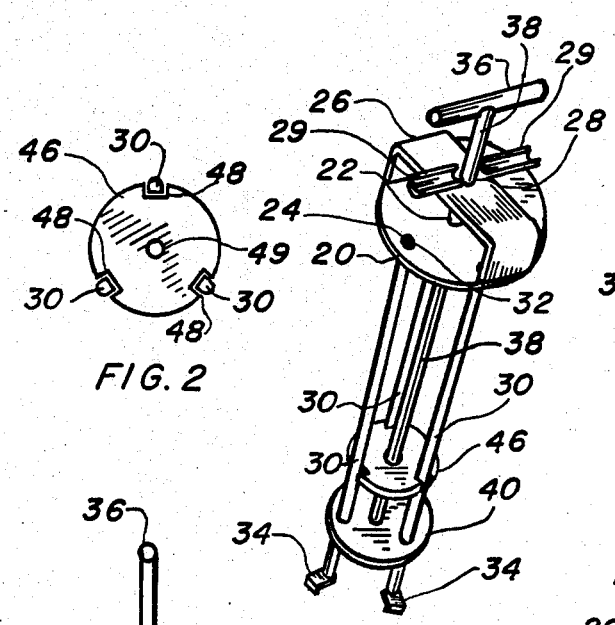
FIG. 1
FIG. 2
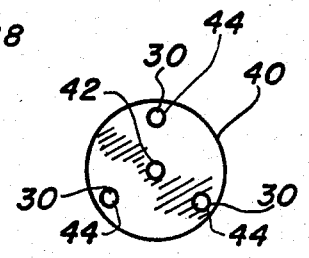
FIG. 3
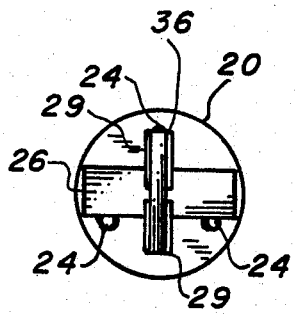
FIG. 4
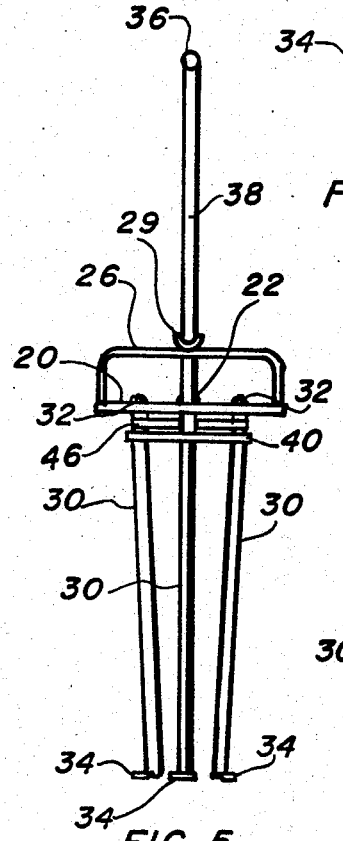
FIG. 5
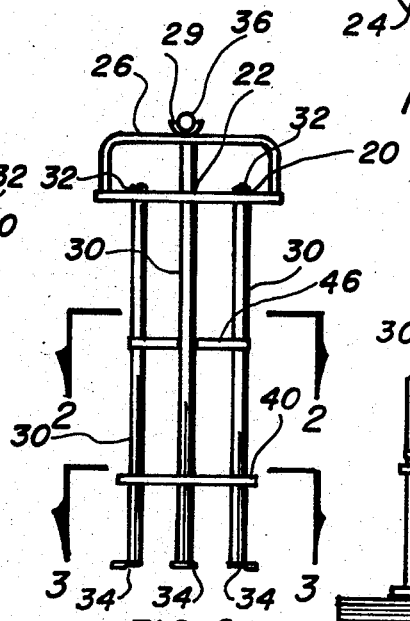
FIG. 6
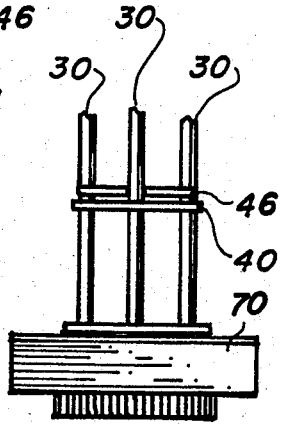
FIG. 7

TRANSMISSION DIRECT CLUTCH DRUM REMOVING AND INSTALLING TOOL

TECHNICAL FIELD

This invention relates to automotive assembly tools in general, and more specifically to a hand tool for removing and installing a direct clutch drum in a General Motors Corporation Turbo-Hydromatic 400 automatic transmission.

BACKGROUND ART

Previously many tools have been developed in endeavoring to provide an effective means for assembling various components for automatic transmissions and other automotive components. In most cases, universal tools have been in use that may be adapted for a given application, but the capabilities to easily accomplish a specific task, such as described above, in an economic manner has been lacking.

A search of the prior art did not disclose any patents that read directly on the claims of the instant invention, however, the following U.S. patents were considered related:

| U.S.PAT. NO. | INVENTOR | ISSUE DATE |
|---|---|---|
| 3,516,143 | Lewallen | June 23, 1970 |
| 3,115,699 | Nakahira | Dec. 31, 1963 |
| 3,078,556 | Carroll | Feb. 26, 1963 |
| 2,697,273 | Clarke et al | Dec. 21, 1954 |
| 2,484,129 | Taylor | Oct. 11, 1949 |
| 2,407,428 | Kretchman | Sep. 10, 1946 |

Lewallen teaches a linear puller with an elongated center shaft with a hydraulic operated piston reciprocably received for extension from one end of a rod with a plurality of arms pivotally secured thereunto. As the rod is slid inwardly, the arms expand through leverage and grasp the workpiece with the shoulder of the leg.

Nakahira utilizes a manual or power assisted spring compressing tool utilizing an arbor or a hydraulic press applying linear force upon a head having four arms, each containing a downwardly depending leg. A center rod utilizes the head allowing the arms to descend simultaneously compressing the specific springs in the process.

Carroll practices a button plate having a threaded rod centrally located therein with a top plate having three push pins depending downwardly. A nut on the threaded rod is rotated applying the force to distend the pins upon the direct clutch springs.

Both Clarke et al and Taylor teach a puller having pivotal legs with a threaded rod in the middle of a spider. When the rod is rotated, a spreader cone forces the legs inward grasping the workpiece, and the rod applies pressure thereunto.

Kretchman uses a plurality of spring tensioned arms attached to a block with each arm having a beveled tip and a hook applied over the workpiece with a plate attached to a stem in the middle providing means to deliver a hammerlike blow in an upward direction to the arms for removing a cover on a container.

DISCLOSURE OF THE INVENTION

Many and varied approaches have been used to assist the mechanic in assembling the components within a direct clutch for an automatic transmission. Since there are literally hundreds of various configurations on the present market, most tools have been developed that may be universally used. This situation requires much adaptation on the part of the mechanic as certain liberties must be taken in order to utilize the principles inherent in the tool. Since this procedure takes time for adjustment and does not exactly fit and could take other combinations of tools to obtain a working function, it is the primary object of the invention to provide a tool that will specifically fit the direct clutch drum of a General Motors Corporation Turbo-Hydromatic 400 automatic transmission. This allows the mechanic to quickly and easily accomplish this assembly procedure without any undo hardship previously encountered in this task, and with a minimum of effort. Since the tool is specific for the application, the operation is extremely simple allowing the legs to enter and grab the clutch drum spring retainer while pivoting from the platform and positioning iteself rigidly when the handle is depressed.

This leads to an important object of the invention in that the tool is operated by hand being light in weight and portable, requiring no peripheral equipment for its function. Inasmuch as no threaded rods are utilized, the time to rotate the mechanism is elimianted as only the handle needs to be depressed to accomplish the given assembly task. Further, the expense of the tool is to be considered as another object and inasmuch as the invention is fabricated of simple metal structure and no matching or casting of parts is required, the cost may be considerably less than comparable tools now available as prior art.

These and other objects and advantages of the present invention will become apparent from the subsequent detailed description of the preferred embodiment and the claims taken in conjunction with the accompanying drawings.

BRIEF DESCRIPTION OF THE DRAWINGS

FIG. 1 is a isometric view of the preferred embodiment.

FIG. 2 is a cross-sectional view taken along lines 2—2 of FIG. 6.

FIG. 3 is a cross-sectional view taken along lines 3—3 of FIG. 6.

FIG. 4 is a plan view of the preferred embodiment.

FIG. 5 is a side view of the preferred embodiment with the handle in the open position raised to its maximum extension and the legs grouped together.

FIG. 6 is a side view of the preferred embodiment with the handle depressed and the floating locking disc positioned in the middle of the legs, as in the operating mode.

FIG. 7 is a partial view of the preferred embodiment showing the tool inserted into the workpiece.

BEST MODE FOR CARRYING OUT THE INVENTION

The best mode for carrying out the invention of the transmission direct clutch drum removing and installing tool is presented in terms of a preferred embodiment, as depicted in FIGS. 1 through 7. The invention is comprised of a round plate platform base 20 having a thickness that provides sufficient structural integrity to hold components thereupon in a rigid manner. The base 20 contains, as best shown in FIG. 1, a centrally located clearance hole 22 and a plurality of attaching holes 24 on a radial centerline. Attached to the top periphery of the base 20 is a spacer channel 26 having a bore 28 in the middle. This provides a pair of openings surrounded by a parallel rigid structure for alignment purposes. Attachment of the channel to the base may be by induction welding, brazing, riveting, threaded fasteners, or the like. On the top surface of the channel 26 as best shown in FIGS. 1, 4 and 5, are a pair of half round handle retainers 29. These retainers 29 are in disked, concave shape and may be fabricated of a flat plate formed in such a manner as to have a radial inside surface and a length sufficient to retain at least two fingers of the operators hand when mounted upon the channel 26. An alternate method of constructing the retainer may be by cutting a pipe longitudinally in half making the pair. The positioning of these retainers 29 is at right angles to the top surface of the channel 26 and centrally located with one end almost contiguous with the bore 28, and the other end disposed outwardly in linear alignment with each other. The position of the retainers 29 allows the operator to place at least two of his fingers on one side of the channel 26 and the remainder on the other side when operating the tool. The connection of the elements together may be made by welding, brazing, riveting, or the like, with the material preferably of a ferrous metal.

A plurality of positioning legs 30, preferably three, as shown in FIG. 1, are pivotally connected to the underside of the base 20 through the attaching holes 24 with an attachment means 32. These legs 30 are preferably formed of a solid structural rod having flat inward sides, as best shown in FIG. 2. Each of the legs 30 has a flat outwardly projecting retainer 34 on the end opposite the attaching means 32. This retainer 34 is formed of a rectangular, or square, flat plate with a downwardly desending lip and is attached integrally to the leg by welding, brazing, or the like.

The attachment means connecting the legs 30 to the base 20 may be any method well known in the art, such as a threaded fastener screwed into the end of the leg 30, a pair of nuts threaded on the leg 30, one on each side of the base 20, or a swivel joint, etc. The prerequisite for this method of attachment is that the legs 30 are not rigidly connected, allowing a small amount of movement permitting them to be nested together for insertion inside of the workpiece 70 as shown in FIG. 7.

A T-shaped operating handle is included, as best shown in FIG. 1, that consists of a horizontal handle section 36 that is rigidly attached to a vertical rod 38. The handle section has a length equal to the handle retainers 29 and a circular cross-section to allow the handle to rest within the concave shape of the handle retainer 29. The rod 38 is sized to slidably penetrate the bore 28 in the channel 26, the clearance bore 22 in the base 20, and the clearance bore 44 in a floating locking disc 46. The end of the rod 38 opposite the handle 36 is rigidly attached to a leg directing expansion guide disc 40. This disc 40 consists of a circular plate having a center opening 42, slightly larger than the vertical rod 38 and a plurality of apertures 44 in a spaced array on a radial centerline in alignment with the attaching holes 24 of the base 20. These apertures 44 are sized to allow a slip fit of the legs 30 when positioned within. The center opening 42 is a tight fit to the rod 38 thus allowing the rod to be connected, after assembly, thereto in a fixable manner providing the spacing means for the legs 30 and a surface to compress the components within the workpiece 70. The handle 36 can be easily moved within the base 20 and channel 26 maintaining a linear alignment, and while so doing, expanding the legs 30 to a given radial centerline compatable with that established by the base 20.

The floating locking disc 46, which is loosely disposed between the platform 20 and the leg expansion guide disc 40, is comprised, as shown in FIG. 2, of a flat plate of metal having three penetrations 48 in alignment with the apertures 44 in the disc 46 and the legs 30. The penetrations 48 have an outside edge open to the periphery and a flat inward side that slidably conforms to the cross-section of the legs 30.

The disc 46 slides freely within the confines of the base 20 and the expansion guide disc 40. Thus, assuring the alignment of the legs 30 without binding or internal bowing. In operation the disc 46 may also be manually placed in the middle adding structural integrity to the tool while under the stress of operation.

Since the function of the invention is to assemble a specific direct clutch for a given automatic transmission, the operation is extremely simple and straightforward to understand by one skilled in the art. The tool is manipulated by the mechanic by insertion into the clutch drum while the handle 36 is fully extended with the legs 30 grouped closely together providing easy egress into the opening. The components within the clutch drum, such as the drive and driver plates, the sprag and cone, springs with retainers, etc., are stacked and assembled, then the tool is inserted. When the handle section 36 is pushed downwardly, the legs 30 are forced into their predetermined spaced relationship in alignment with the sides of the clutch drum spring retainer. This final contact position brings the handle 36 into a contiguous locked relationship with the handle lock 29 as best shown in FIG. 6. In this position, the operator can place one of his hands on the combination handle and handle lock while his other hand is placed around the three legs 30. With this gripping configuration, the clutch drum can be removed and/or installed with minimum effort and handling.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims.

I claim:

1. A clutch drum removing and installing tool for a General Motors Corporation Turbo-Hydromatic 400 automatic transmission direct clutch drum comprising:

(a) a round plate platform base having a centrally located clearance hole and a plurality of attaching holes on a radial centerline;

(b) a spacer channel having a bore in the middle thereof affixed upon the top periphery of said base providing a spaced relationship of said clearance hole and said bore for alignment therebetween;

(c) a plurality of positioning legs having attaching means pivotally connected to the underside of said round plate platform base.

(d) a flat outwardly projecting retainer having a downwardly descending lip integral with each positioning leg on the end opposite said attaching means where said retainer grips the compoents within said direct clutch drum; and (e) a T-shaped operating handle comprising a vertical rod having a horizontal handle section on one end and a leg directing expansion guide disc on the other end, where said rod slidably penetrates the clearance bore in said base and the bore in said spacer channel for placement of said legs and containment of components within said clutch drum, operated by insertion of the tool into the drum with the handle extended while the legs are grouped closely together and pushing the handle downwardly so that said handle is in a contiguous relationship with said channel in which position, the legs are forced to expand outwardly to a predetermined spaced relationship in alignment with the sides of the clutch drum.

2. The invention as recited in claim 1 further comprising a floating locking disc having a plurality of penetrations in sliding alignment with said positioning legs with said disc also having a clearance bore that allows said disc to be loosely disposed between said platform and said leg expansion guide disc where said floating locking disc provides a retaining means to assure alignment and prevent internal bowing of said legs when pressure is manually applied upon said operating handle adding structural integrity to said tool while in dynamic operation.

3. The invention as recited in claim 1 further comprising: a pair of half round handle locks connected upon the upper surface of said spacer channel in alignment with the horizontal handle section of said T-shaped operating handle providing a gripping surface to receive the operators fingers while inserting said retainers into the sides of the clutch drum during the final compression stroke forceably bringing the handle into contiguous relationship with the channel.

4. The invention as recited in claim 1 wherein said leg directing expansion guide disc of said operating handle further comprises: a circular plate having a center opening and a plurality of apertures in a spaced array on a radial centerline in alignment with the attaching holes of said round plate platform base, the apertures being slightly larger than said legs allowing a slip-fit therethrough and a tight fitting center opening fixably attaching said operating handle thereunto providing the spacing means for the legs and a surface to grab the components within said clutch drum.

* * * * *